US008998746B2

(12) United States Patent
Boyd et al.

(10) Patent No.: US 8,998,746 B2
(45) **Date of Patent: *Apr. 7, 2015**

(54) GOLF CLUB ASSEMBLY AND GOLF CLUB WITH SOLE PLATE

(75) Inventors: Robert Boyd, Euless, TX (US); Andrew G. V. Oldknow, Portland, OR (US); Kenneth Brown, Beaverton, OR (US)

(73) Assignee: NIKE, Inc., Beaverton, OR (US)

( * ) Notice: Subject to any disclaimer, the term of this patent is extended or adjusted under 35 U.S.C. 154(b) by 0 days.

This patent is subject to a terminal disclaimer.

(21) Appl. No.: 13/532,055

(22) Filed: Jun. 25, 2012

(65) Prior Publication Data

US 2012/0289359 A1 Nov. 15, 2012

Related U.S. Application Data

(63) Continuation of application No. 12/509,861, filed on Jul. 27, 2009, now Pat. No. 8,206,241.

(51) Int. Cl.
*A63B 53/04* (2006.01)
*A63B 59/00* (2006.01)

(52) U.S. Cl.
CPC ..... *A63B 53/047* (2013.01); *A63B 53/0466* (2013.01); *A63B 59/0092* (2013.01); *A63B 2053/0433* (2013.01); *A63B 2209/00* (2013.01)

(58) Field of Classification Search
USPC ..... 473/324–350
See application file for complete search history.

(56) References Cited

U.S. PATENT DOCUMENTS

| | | | | | |
|---|---|---|---|---|---|
| 1,611,110 | A | * | 12/1926 | East | 473/342 |
| 2,429,351 | A | * | 10/1947 | Fetterolf | 473/329 |
| 3,881,733 | A | * | 5/1975 | Csernits | 473/330 |
| 4,398,965 | A | * | 8/1983 | Campau | 148/522 |
| 4,811,950 | A | * | 3/1989 | Kobayashi | 473/335 |
| 4,890,840 | A | * | 1/1990 | Kobayashi | 473/344 |
| 4,964,640 | A | * | 10/1990 | Nakanishi et al. | 473/335 |
| 5,421,574 | A | * | 6/1995 | Yamagishi et al. | 473/282 |
| 5,439,223 | A | * | 8/1995 | Kobayashi | 473/334 |
| 5,492,327 | A | * | 2/1996 | Biafore, Jr. | 473/332 |
| 5,509,659 | A | * | 4/1996 | Igarashi | 473/345 |
| 5,518,243 | A | * | 5/1996 | Redman | 473/334 |
| 5,540,436 | A | * | 7/1996 | Boone | 473/350 |
| 5,582,553 | A | * | 12/1996 | Ashcraft et al. | 473/345 |
| 5,643,111 | A | * | 7/1997 | Igarashi | 473/332 |
| 5,665,014 | A | * | 9/1997 | Sanford et al. | 473/345 |
| 5,676,606 | A | * | 10/1997 | Schaeffer et al. | 473/340 |

(Continued)

FOREIGN PATENT DOCUMENTS

| | | | | |
|---|---|---|---|---|
| EP | 556502 A1 | * | 8/1993 | A63B 53/04 |
| EP | 909827 A2 | * | 4/1999 | C22C 14/00 |

(Continued)

OTHER PUBLICATIONS

Jackson, Jeff. "The Modern Guide to Golf Clubmaking," Ohio: Dynacraft Golf Products, Inc., copyright 1994., p. 238.*

(Continued)

*Primary Examiner* — Alvin Hunter
(74) *Attorney, Agent, or Firm* — Banner & Witcoff, Ltd.

(57) ABSTRACT

A body member has a face plate and a first engaging member. A sole plate has a second engaging member, the first and second engaging members being interlocked with one another. A layer of resilient material is disposed between the first engaging member and the second engaging member.

16 Claims, 4 Drawing Sheets

(56) References Cited

U.S. PATENT DOCUMENTS

| | | | | | |
|---|---|---|---|---|---|
| 5,692,972 | A * | 12/1997 | Langslet | 473/332 |
| 5,766,092 | A * | 6/1998 | Mimeur et al. | 473/329 |
| 5,833,551 | A * | 11/1998 | Vincent et al. | 473/350 |
| 6,045,456 | A * | 4/2000 | Best et al. | 473/291 |
| 6,086,485 | A * | 7/2000 | Hamada et al. | 473/329 |
| 6,093,112 | A * | 7/2000 | Peters et al. | 473/291 |
| 6,095,931 | A * | 8/2000 | Hettinger et al. | 473/341 |
| 6,099,414 | A * | 8/2000 | Kusano et al. | 473/342 |
| 6,149,534 | A * | 11/2000 | Peters et al. | 473/345 |
| 6,159,109 | A * | 12/2000 | Langslet | 473/332 |
| 6,183,376 | B1 * | 2/2001 | Peters et al. | 473/291 |
| 6,319,149 | B1 * | 11/2001 | Lee | 473/342 |
| 6,354,956 | B1 | 3/2002 | Doong | |
| 6,358,158 | B2 * | 3/2002 | Peters et al. | 473/291 |
| 6,368,232 | B1 | 4/2002 | Hamada et al. | |
| 6,475,427 | B1 * | 11/2002 | Deshmukh et al. | 419/8 |
| 6,478,690 | B2 * | 11/2002 | Helmstetter et al. | 473/324 |
| 6,554,719 | B2 * | 4/2003 | Peters et al. | 473/291 |
| 6,709,345 | B2 * | 3/2004 | Iwata et al. | 473/291 |
| 6,743,112 | B2 * | 6/2004 | Nelson | 473/251 |
| 6,835,144 | B2 * | 12/2004 | Best | 473/332 |
| 6,976,924 | B2 * | 12/2005 | Gilbert et al. | 473/332 |
| 6,986,716 | B2 * | 1/2006 | Lukasiewicz et al. | 473/340 |
| 6,991,559 | B2 * | 1/2006 | Yabu | 473/332 |
| 6,991,560 | B2 * | 1/2006 | Tseng | 473/332 |
| 7,094,159 | B2 * | 8/2006 | Takeda | 473/345 |
| 7,226,366 | B2 * | 6/2007 | Galloway | 473/342 |
| 7,244,188 | B2 * | 7/2007 | Best | 473/291 |
| 7,281,989 | B2 * | 10/2007 | Hou et al. | 473/326 |
| 7,297,072 | B2 | 11/2007 | Meyer et al. | |
| 7,316,623 | B2 * | 1/2008 | Imamoto | 473/332 |
| 7,473,186 | B2 * | 1/2009 | Best et al. | 473/329 |
| 7,582,024 | B2 * | 9/2009 | Shear | 473/329 |
| 7,588,503 | B2 * | 9/2009 | Roach et al. | 473/332 |
| 7,641,569 | B2 * | 1/2010 | Best et al. | 473/329 |
| 7,686,704 | B2 * | 3/2010 | Gilbert et al. | 473/290 |
| 7,713,141 | B2 * | 5/2010 | Yamamoto | 473/332 |
| 7,744,486 | B2 * | 6/2010 | Hou et al. | 473/329 |
| 7,749,101 | B2 * | 7/2010 | Imamoto et al. | 473/332 |
| 7,850,544 | B2 * | 12/2010 | Meyer et al. | 473/329 |
| 7,857,711 | B2 * | 12/2010 | Shear | 473/329 |
| 7,922,604 | B2 * | 4/2011 | Roach et al. | 473/350 |
| 7,997,999 | B2 * | 8/2011 | Roach et al. | 473/332 |
| 8,062,150 | B2 * | 11/2011 | Gilbert et al. | 473/332 |
| 8,206,241 | B2 * | 6/2012 | Boyd et al. | 473/332 |
| 8,388,464 | B2 * | 3/2013 | Gilbert et al. | 473/332 |
| 2003/0022730 | A1 | 1/2003 | Nelson et al. | |
| 2003/0092502 | A1 * | 5/2003 | Pergande et al. | 473/332 |
| 2005/0096150 | A1 * | 5/2005 | Hou et al. | 473/332 |
| 2005/0192116 | A1 * | 9/2005 | Imamoto | 473/329 |
| 2006/0194641 | A1 | 8/2006 | Best | |
| 2006/0287127 | A1 | 12/2006 | Billings | |
| 2006/0287132 | A1 | 12/2006 | Meyer et al. | |
| 2007/0049400 | A1 | 3/2007 | Imamoto | |
| 2007/0099721 | A1 | 5/2007 | Chen | |
| 2007/0099727 | A1 | 5/2007 | Sugimoto | |
| 2007/0202963 | A1 | 8/2007 | Oyama | |
| 2009/0082131 | A1 | 3/2009 | Best et al. | |
| 2009/0143167 | A1 | 6/2009 | Evans | |

FOREIGN PATENT DOCUMENTS

| | | | | | |
|---|---|---|---|---|---|
| GB | 2445056 | A * | 6/2008 | | A63B 53/04 |
| JP | 02180281 | A * | 7/1990 | | A63B 53/04 |
| JP | 05245233 | A * | 9/1993 | | A63B 53/04 |
| JP | 05277214 | A * | 10/1993 | | A63B 53/04 |
| JP | 06121848 | A * | 5/1994 | | A63B 53/04 |
| JP | 06121851 | A * | 5/1994 | | A63B 53/04 |
| JP | 08038658 | A * | 2/1996 | | A63B 53/04 |
| JP | 08047554 | A * | 2/1996 | | A63B 53/04 |
| JP | 10151231 | A * | 6/1998 | | A63B 53/04 |
| JP | 2000005357 | A * | 1/2000 | | A63B 53/04 |
| JP | 2000296192 | A * | 10/2000 | | A63B 53/04 |
| JP | 2001070485 | A * | 3/2001 | | A63B 53/04 |
| JP | 2002052100 | A * | 2/2002 | | A63B 53/04 |
| JP | 2002253713 | A * | 9/2002 | | A63B 53/04 |
| JP | 2002-224254 | A | 10/2002 | | |
| JP | 2002-533180 | A | 10/2002 | | |
| JP | 2003093550 | A * | 4/2003 | | A63B 53/00 |
| JP | 2003175135 | A * | 6/2003 | | A63B 53/04 |
| JP | 2004216131 | A * | 8/2004 | | A63B 53/04 |
| JP | 2004-242952 | A | 9/2004 | | |
| JP | 2004242952 | A * | 9/2004 | | A63B 53/04 |
| JP | 2004298441 | A * | 10/2004 | | A63B 53/04 |
| JP | 2005118526 | A * | 5/2005 | | A63B 53/04 |
| JP | 2005312940 | A * | 11/2005 | | A63B 53/06 |
| JP | 2006-231064 | A | 9/2006 | | |
| JP | 2006263440 | A * | 10/2006 | | |
| JP | 2007-021171 | A | 2/2007 | | |
| JP | 2008018008 | A * | 1/2008 | | |
| JP | 2008279249 | A * | 11/2008 | | |
| WO | 9709095 | A1 | 3/1997 | | |
| WO | WO 9709095 | A1 * | 3/1997 | | A63B 53/04 |
| WO | WO 9920358 | A1 * | 4/1999 | | A63B 53/04 |

OTHER PUBLICATIONS

International Search Report and Written Opinion issued Nov. 23, 2010, in PCT Application No. PCT/US2010/042871.

Reason for Rejection dated Aug. 29, 2013, in corresponding Japanese Application No. 2012-522907.

Office Action issued Oct. 8, 2013 in corresponding Chinese Patent Application No. 201080033360.1.

* cited by examiner

GOLF CLUB ASSEMBLY AND GOLF CLUB WITH SOLE PLATE

RELATED APPLICATIONS

This application is a continuation application of U.S. application Ser. No. 12/509,861, filed on Jul. 27, 2009, which is incorporated herein by reference in its entirety.

FIELD

Aspects of this invention relate generally to golf clubs and golf club heads, and, in particular, to golf clubs and golf club heads having a sole plate isolated from the club head with a resilient material.

BACKGROUND

Golfers tend to be sensitive to the "feel" of a golf club. The "feel" of a golf club comprises the combination of various component parts of the club and various features associated with the club that produce the sensations experienced by the player when a ball is swung at and/or struck. Club weight, weight distribution, swing weight, aerodynamics, swing speed, and the like all may affect the "feel" of the club as it is swung and strikes a ball. "Feel" also has been found to be related to the vibrations produced when a club head face strikes a ball to send the ball in motion. These vibrations are transmitted from the club head through the shaft to the user's hands. If the user senses these vibrations, the user may flinch, give up on his/her swing, decelerate the swing, lose his/her grip, and/or not completely follow-through on the swing, thereby affecting distance, direction, and/or other performance aspects of the swing and the resulting ball motion. User anticipation of these undesirable vibrations can affect a swing even before the ball is hit.

Isolating the vibration created at the face of the club head from the shaft would result in an improved "feel" for the user. It would be desirable to provide a golf club head that reduces or overcomes some or all of the difficulties inherent in prior known devices. Particular advantages will be apparent to those skilled in the art, that is, those who are knowledgeable or experienced in this field of technology, in view of the following disclosure of the invention and detailed description of certain embodiments.

SUMMARY

The principles of the invention may be used to provide a golf club with a sole plate suspended along a lower surface of a body member of a club head. In accordance with a first illustrative aspect, a body member has a face plate and a first engaging member. A sole plate has a second engaging member, the first and second engaging members being interlocked with one another. A layer of resilient material is disposed between the first engaging member and the second engaging member.

In accordance with another illustrative aspect, a golf club assembly includes a shaft and a club head secured to a first end of the shaft. The club head includes a body member having a first engaging member. A sole plate has a second engaging member, with the first and second engaging members being interlocked with one another. A layer of resilient material is disposed between the first engaging member and the second engaging member.

In accordance with a further illustrative aspect, a golf club assembly includes a shaft and a club head secured to a first end of the shaft. The club head includes a body member having a first engaging member. A sole plate has a second engaging member, with the first and second engaging members being interlocked with one another. A layer of resilient material is disposed between the first engaging member and the second engaging member.

By providing a sole member suspended on a body member club head of a golf club according to certain embodiments, the amount of vibration sensed by the hands of a user when a golf ball is struck with the golf club can be reduced. As such, the "feel" of the club for the user may be improved, making the user more comfortable with their swing, and more likely to have confidence in their swing.

These and additional features and advantages disclosed here will be further understood from the following detailed disclosure of certain embodiments.

Figure 1:
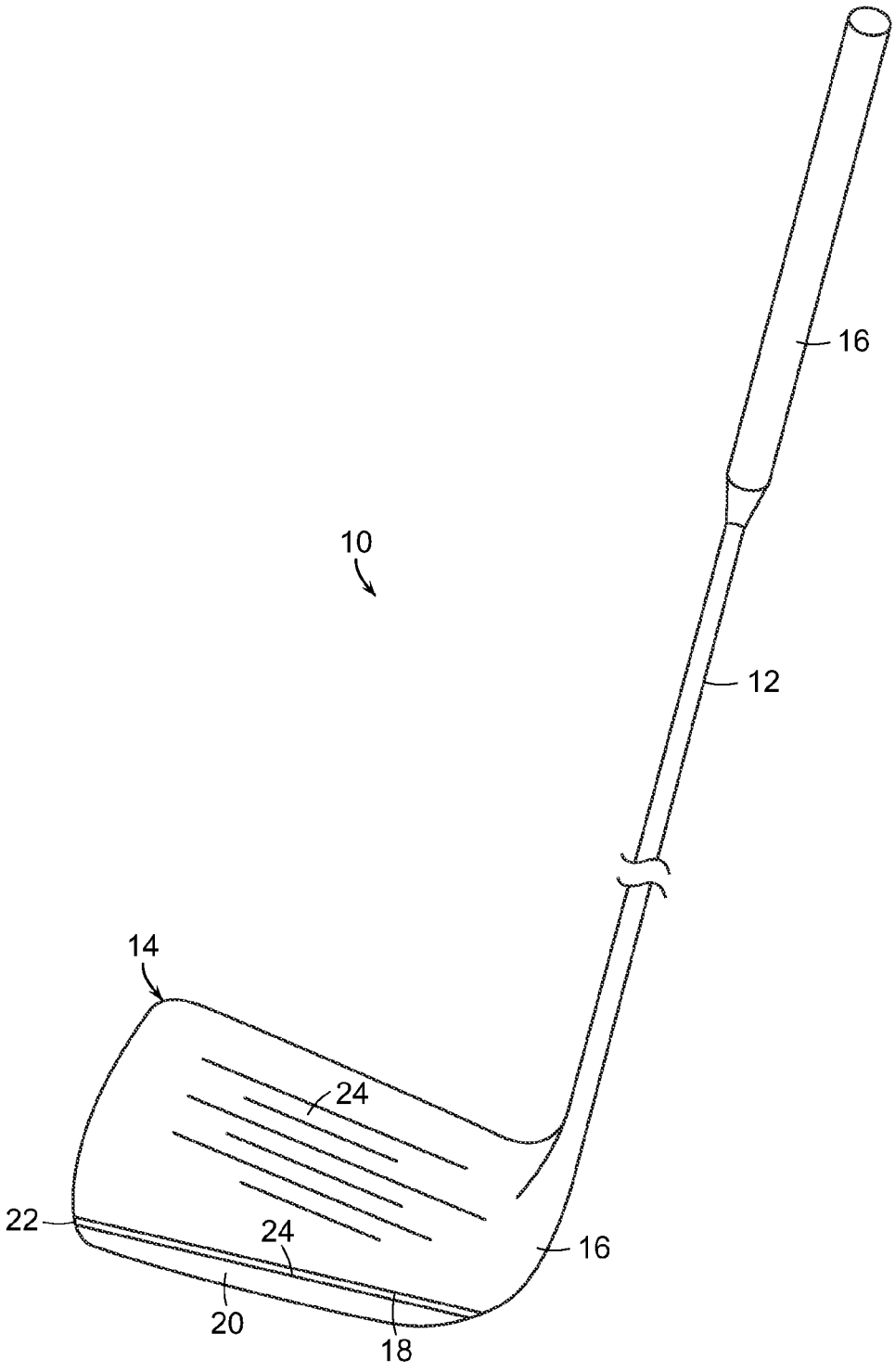
FIG. 1 is a perspective view of a golf club with a sole plate secured to the club head with a layer of resilient material.

The figures referred to above are not drawn necessarily to scale, should be understood to provide a representation of particular embodiments of the invention, and are merely conceptual in nature and illustrative of the principles involved. Some features of the golf club with a sole member depicted in the drawings have been enlarged or distorted relative to others to facilitate explanation and understanding. The same reference numbers are used in the drawings for similar or identical components and features shown in various alternative embodiments. Golf clubs with sole members as disclosed herein would have configurations and components determined, in part, by the intended application and environment in which they are used.

DETAILED DESCRIPTION OF CERTAIN PREFERRED EMBODIMENTS

An illustrative embodiment of a golf club 10 is shown in FIG. 1 and includes a shaft 12 and a golf club head 14 attached to shaft 12. Golf club head 14 may be any driver, wood, or the like. Shaft 12 of golf club 10 may be made of various materials, such as steel, aluminum, titanium, graphite, or composite materials, as well as alloys and/or combinations thereof, including materials that are conventionally known and used in the art. Additionally, the shaft 12 may be attached to the club head 14 in any desired manner, including in conventional manners known and used in the art (e.g., via adhesives or cements at a hosel element, via fusing techniques (e.g., welding, brazing, soldering, etc.), via threads or other mechanical connectors, via friction fits, via retaining element structures, etc.). A grip or other handle element 16 is positioned on shaft 12 to provide a golfer with a slip resistant surface with which to grasp golf club shaft 12. Grip element 16 may be attached to shaft 12 in any desired manner, including in conventional manners known and used in the art (e.g., via adhesives or cements, via threads or other mechanical connectors, via fusing techniques, via friction fits, via retaining element structures, etc.).

Figure 2:
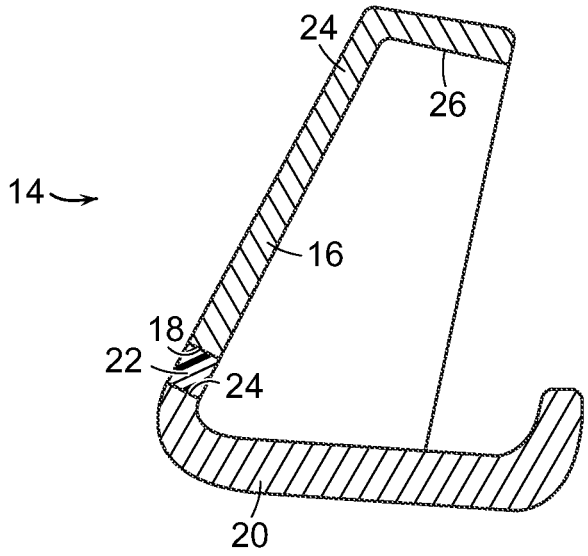
FIG. 2 is a section view of the club head of the golf club of FIG. 1.
Figure 3:
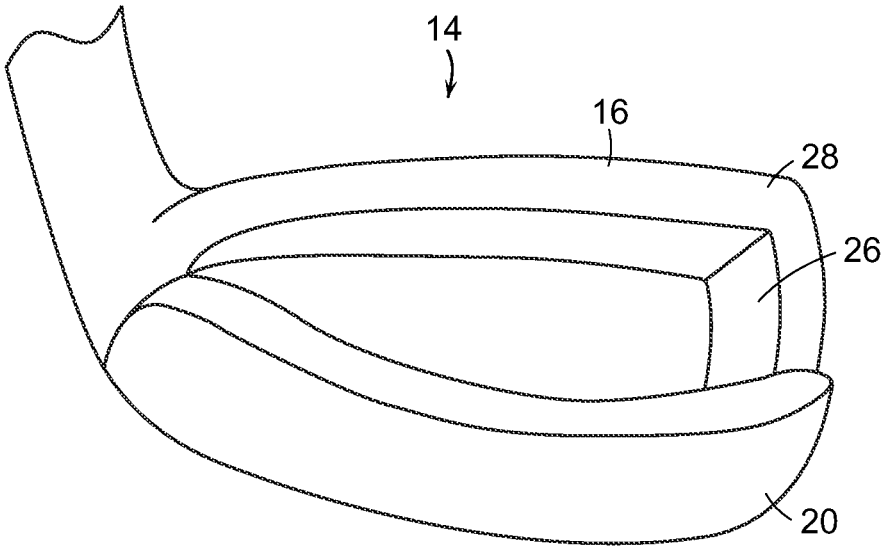
FIG. 3 is a rear perspective view of club head of the golf club of FIG. 1.

Club head 14 includes a plurality of components. As illustrated in FIGS. 2-3, this example golf club head 14 includes a body member 16 with a lower surface 18, and a sole plate 20 positioned beneath and spaced from bottom surface 18 of body member 16. Sole plate 20 is secured to bottom surface 18 of body member 16 with a layer of resilient material 22 that extends between an upper surface 24 of sole plate 20 and bottom surface 18 of body member 16. In certain embodiments, body member 16 includes a face plate 24, and sole plate 20 is positioned beneath and spaced from a bottom surface 18 of face plate 24.

Resilient material 22 is a resilient, pliable, and flexible visco-elastic damping material material that serves to isolate elements of club head 14 from one another, thereby reducing the vibration transmitted from one element to another. Resilient material 22 converts vibratory energy to heat, thus reducing the shock experienced by the golfer. In certain embodiments, resilient material 22 is urethane. Other suitable materials for resilient material 22 include elastomers and epoxy. Other suitable materials for resilient material 22 will become readily apparent to those skilled in the art, given the benefit of this disclosure.

The use of resilient material 22 between sole plate 20 and body member 16, or face plate 24, serves to provide a way to suspend sole plate 20, and isolate the vibrations created by the impact of a golf ball with face plate 24 from the remainder of golf club 10, and in particular shaft 12 so that the vibrations felt by the user are reduced.

Sole plate 20 is a significant mass, the vibration of which, when connected to body member 16 by resilient material 22, tends to cancel out some of the vibrations produced when face plate 24 of body member 16 is struck by a golf ball. Consequently, the vibrations felt by the user grasping shaft 12 are reduced, resulting in an improved "feel" and level of comfort for the user.

In certain embodiments, sole plate 20 may comprise between approximately 12% and 30% of the total weight of club head 14. For example, sole plate 20 may have a weight of approximately 40-60 grams with a club head 14 total weight of between approximately 200 and approximately 330 grams.

In certain embodiments, as illustrated in FIGS. 2-3, club head 14 may include a cavity 26 formed in a rear surface 28 of body member 16, thereby forming what is commonly referred to as a "cavity-backed" club head. In such an embodiment, sole plate 20 is suspended beneath cavity 26.

Figure 4:
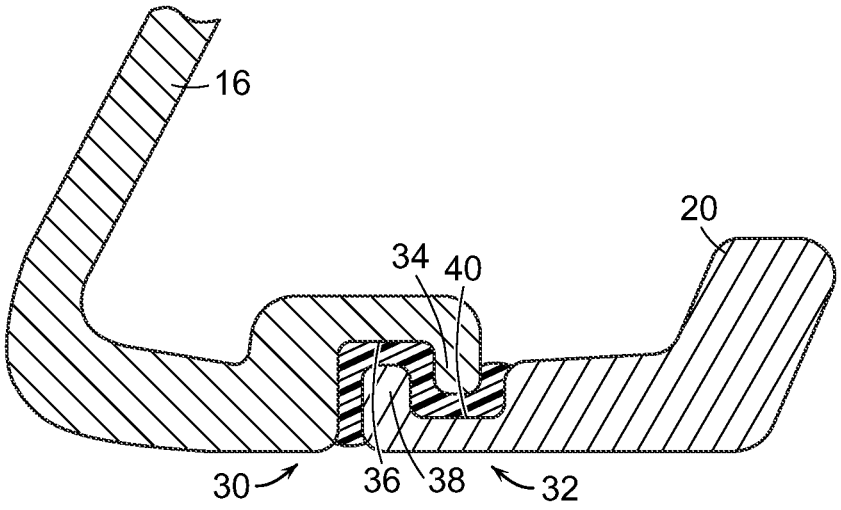
FIG. 4 is a section view of a portion of an alternative embodiment of a golf club head with a sole plate secured to the club head with a layer of resilient material.

Another embodiment is illustrated in FIG. 4, in which body member 16 includes a first engaging member 30 and sole plate 20 includes a second engaging member 32. First engaging member 30 and second engaging member 32 are configured to engage and interlock with one another, with resilient material 22 positioned therebetween, so as to help secure sole plate 20 to body member 16.

In this embodiment, first engaging member 30 includes a first rib 34 that extends downwardly. Body member 16 and first rib 34 define a downwardly opening first channel 36. Second engaging member 32 includes a second rib 38 that extends upwardly. Sole plate 20 and second rib 38 define an upwardly opening second channel 40. First rib 34 is received in second channel 40 and second rib 38 is received in first channel 36, with resilient material 22 positioned between first engaging member 30 and second engaging member 32 so as to fill first and second channels 36, 40. Thus, First engaging member 30 and second engaging member 32 interlock with one another to help secure sole plate 20 to body member 16.

Figure 5:
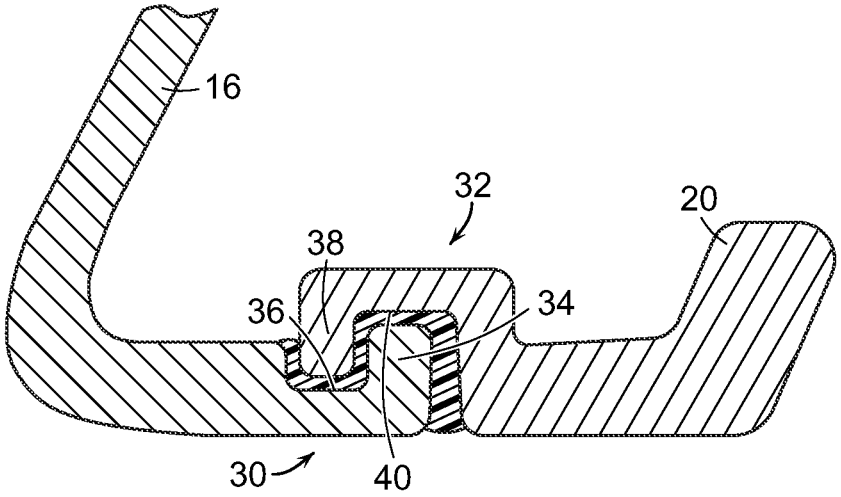
FIG. 5 is a section view of a portion of another alternative embodiment of a golf club head with a sole plate secured to the club head with a layer of resilient material.

Another embodiment is illustrated in FIG. 5, in which first rib 34 extends upwardly, first channel 36 opens upwardly, second rib 38 extends downwardly, and second channel 40 opens downwardly. First and second engaging members 30, 32 interlock in similar fashion as described above with respect to FIG. 4.

Figure 6:
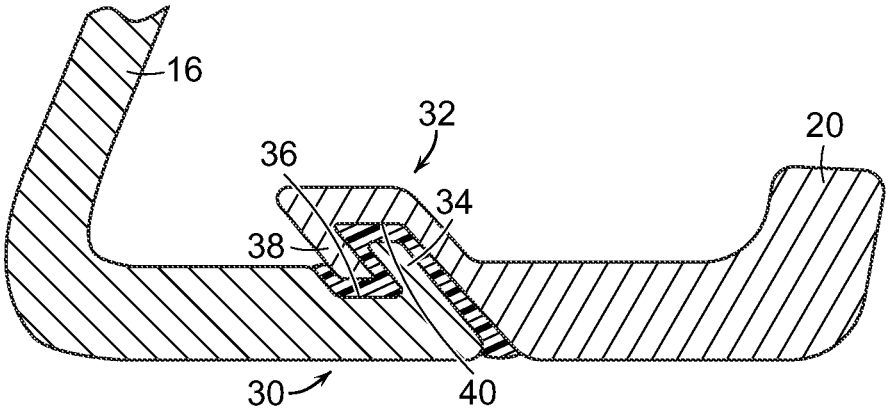
FIG. 6 is a section view of a portion of yet another alternative embodiment of a golf club head with a sole plate secured to the club head with a layer of resilient material.

Yet another embodiment is illustrated in FIG. 6, in which first rib 34 extends at an angle upwardly and towards a front of body member 16. First channel 36 opens at an angle upwardly and towards a front of body member 16. Second rib 38 extends at an angle downwardly toward a rear of sole plate 20, and second channel 40 similarly opens at an angle downwardly toward the rear of sole plate 20.

Figure 7:
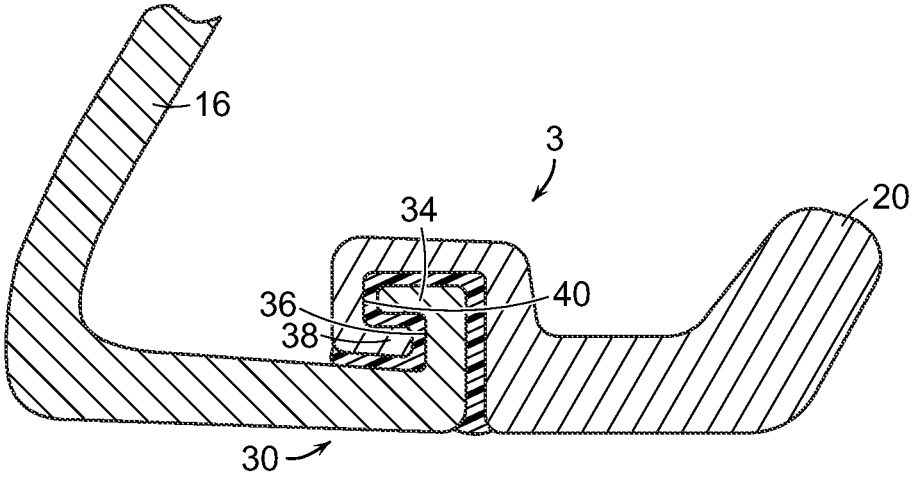
FIG. 7 is a section view of a portion of a further alternative embodiment of a golf club head with a sole plate secured to the club head with a layer of resilient material.

A further embodiment is illustrated in FIG. 7, in which first rib 34 extends forwardly toward the front of body member 16 and first channel 36 opens forwardly toward the front of body member 16. Second rib 38 extends rearwardly toward the rear of sole plate 20, and second channel 40 opens rearwardly toward the rear of sole plate 20. First and second engaging members 30, 32 interlock in similar fashion as described above with respect to FIG. 4.

Thus, while there have been shown, described, and pointed out fundamental novel features of various embodiments, it will be understood that various omissions, substitutions, and changes in the form and details of the devices illustrated, and in their operation, may be made by those skilled in the art without departing from the spirit and scope of the invention. For example, it is expressly intended that all combinations of those elements and/or steps which perform substantially the same function, in substantially the same way, to achieve the same results are within the scope of the invention. Substitutions of elements from one described embodiment to another are also fully intended and contemplated. It is the intention, therefore, to be limited only as indicated by the scope of the claims appended hereto.

What is claimed is:

1. A golf club head comprising:

a body member;

a sole plate positioned beneath and spaced from the body member, a rear end of the sole plate being free of and extending rearwardly from the body member such that a top surface, a bottom surface, and a rear surface of the rear end are exposed to an exterior of the golf club head;

a layer of resilient material disposed between the body member and the sole plate, the resilient material serving to suspend the sole plate from the body member; and wherein the resilient material includes a substantially vertical portion that extends downwardly from a substantially horizontal portion that extends rearwardly.

2. The golf club head of claim 1, wherein the resilient material is urethane.

3. The golf club head of claim 1, wherein the resilient material is an elastomer.

4. The golf club head of claim 1, wherein the body member is a cavity-backed member.

5. The golf club head of claim 1, wherein a weight of the sole plate is between approximately 12% and approximately 30% of a weight of the golf club head.

6. The golf club head of claimer 1, wherein the resilient material is a continuous piece of material.

7. A golf club head comprising:

a body member, a sole plate positioned beneath and spaced from the body member, and a resilient material disposed between the body member and the sole plate configured to allow the sole plate to vibrate in a manner to cancel some of the vibrations of the body member when striking a golf ball;

wherein the resilient material includes a substantially vertical portion that extends downwardly from a substantially horizontal portion that extends rearwardly.

8. The golf club head of claim 7, wherein the resilient material secures the soleplate to the body member.

9. The golf club head of claim 7, wherein a weight of the sole plate is between approximately 12% and 30% of a total weight of the golf club head.

10. The golf club head of claim 7, wherein a total golf club head weight is between 200 and 330 grams.

11. The golf club head of claim 7, wherein the resilient material is a continuous piece of material.

12. The golf club head of claim 7 wherein the body member includes a first vertical engaging surface and a first horizontal engaging surface, wherein the first vertical engaging surface and the first horizontal engaging surface are adjacent to one another; and wherein the sole plate includes a second vertical engaging surface and a second horizontal engaging surface, wherein the second vertical engaging surface and the second horizontal engaging surface are adjacent to one another;

wherein the substantially vertical portion of the resilient material is disposed between the first vertical engaging surface and the second vertical engaging surface and the substantially horizontal portion of the resilient layer is disposed between the first horizontal engaging surface and the second engaging horizontal surface.

13. The golf club head of claim 12 wherein the first vertical engaging surface is substantially parallel to the second vertical engaging surface; and wherein the first horizontal engaging surface is substantially parallel to the second engaging horizontal surface.

14. The golf club head of claim 12 wherein the first vertical engaging surface and the second vertical engaging surface are substantially perpendicular to a bottom surface of the golf club head; and wherein the first horizontal surface and the second horizontal surface are substantially parallel to the bottom surface of the golf club head.

15. A golf club head comprising:

a body member containing a face, a hosel, and at least a first engaging surface and a second engaging surface, wherein the first and second engaging surfaces of the body member are adjacent to one another;

a sole plate positioned beneath and spaced from the body member, containing at least a first and a second engaging surface, a rear end of the sole plate extending rearwardly from the body member such that at least a portion of a top surface, a bottom surface, and a rear surface of the rear end are exposed to an exterior of the golf club head, wherein the first and second engaging surfaces of the sole plate are adjacent to one another; and a layer of resilient material disposed between the first and the second engaging surfaces of the body member and first and the second engaging surfaces of the sole plate, the resilient material serving to suspend the sole plate from the body member; and wherein the resilient material includes a substantially vertical portion that extends downwardly from a substantially horizontal portion that extends rearwardly.

16. The golf club head of claim 15, wherein the resilient material is a continuous piece of material.

* * * * *